US005876516A

United States Patent [19]

Miller et al.

[11] Patent Number: 5,876,516

[45] Date of Patent: Mar. 2, 1999

[54] METHOD FOR CLEANING WINDOW BLINDS

[75] Inventors: Gale W. Miller; James P. Rogers, both of Cincinnati; Michael A. Brooks, Cleves, all of Ohio

[73] Assignee: Norwood Dry Cleaning Unlimited, Cincinnati, Ohio

[21] Appl. No.: 828,957

[22] Filed: Mar. 28, 1997

[51] Int. Cl.[6] ..... B08B 3/04; B08B 7/04

[52] U.S. Cl. ..... 134/37; 134/26; 134/29; 134/34

[58] Field of Search ..... 134/26, 29, 34, 134/37

[56] References Cited

U.S. PATENT DOCUMENTS

| | | | |
|---|---|---|---|
| 654,647 | 7/1900 | Koppleman . | |
| 950,973 | 3/1910 | Wallace . | |
| 2,241,337 | 5/1941 | Work | 261/71 |
| 2,263,624 | 11/1941 | Goetz et al. | 15/230 |
| 2,318,884 | 5/1943 | O'Kelley | 15/77 |
| 2,334,232 | 11/1943 | Wells | 12/1 |
| 2,682,676 | 7/1954 | Franchi | 15/77 |
| 3,094,740 | 6/1963 | Reeves | 17/11.2 |
| 3,314,819 | 4/1967 | Dyer | 134/6 |
| 4,897,122 | 1/1990 | Schreiber et al. | 171/161 |
| 5,062,438 | 11/1991 | Micheletti | 134/9 |
| 5,090,430 | 2/1992 | Nixon | 134/184 |

*Primary Examiner*—Zeinab El-Arini
*Attorney, Agent, or Firm*—Wood, Herron & Evans, L.L.P.

[57] ABSTRACT

Window blinds are cleaned by suspending a blind in a tank containing a bath of water. Pressurized air and water are discharged from openings in elongated conduits into the bath so as to form vortices contacting the blind. After the blind is washed, it is rinsed and dried.

8 Claims, 2 Drawing Sheets

METHOD FOR CLEANING WINDOW BLINDS

BACKGROUND OF THE INVENTION

The present invention relates to cleaning apparatus and methods and is particularly directed to an apparatus and method for cleaning window blinds.

Window blinds adapted to be cleaned in the present apparatus are of two general types. The first type comprises a plurality of slats formed of metal, plastic or wood or the like. These slats are supported in a spaced, parallel relationship to one another by means of spaced tapes. As is well known in the art, a suitable mechanism is provided for pivoting the slats in unison about their longitudinal axis between an "open" position in which the slats are substantially horizontal with a maximum spacing between them and a "closed" position in which the slats are pivoted into a generally vertical overlapping position. Additionally the window blind may be placed in either a "raised" or "lowered" position. In the "raised[|P]' position the slats are drawn together so that the vertical height of the blind is the order of a foot or less, as opposed to its normal length of several feet in the "open" position in which the slats are spaced a maximum distance from one another.

A second type of window blind is the "cloth" type. This type of blind includes a panel of translucent cloth or other flexible material having a plurality of spaced horizontal creases which form accordion like folds. This type of blind is supported by a mechanism which permits it to be raised to a compacted position in which the folds are closely adjacent to one another or lowered to an extended position in which the panel assumes a generally planer position.

It is well known that window blinds tend to get dirty after a period of use due to an accumulation of substances such as dirt, soot, grease and other foreign matter. Cleaning window blinds by hand is a very slow and costly process. Moreover, it is difficult to clean the blinds effectively so as to completely eliminate any residual streaks and spots. In the past various types of equipment have been proposed for cleaning window blinds. Each of these items or pieces of equipment have been subject to one or more defects, such as the expense and complexity of the apparatus or the necessity of disassembling the blinds so that the slats may be cleaned individually.

Typical prior art window blind washers are shown in Goetz U.S. Pat. No. 2,263,624 and Webb U.S. Pat. No. 2,313,606, which show complex machines through which the blind slats are passed. One obvious defect with the equipment shown in these patents is that the blinds must be disassembled to permit the individual slats to be fed through the cleaning equipment.

Kelley U.S. Pat. No. 2,318,884 discloses a window blind cleaning device in which the slats are cleaned by means of brushes.

Another blind cleaning device utilizing brushes in combination with sprayed air and sprayed liquid detergent is shown in Franchi U.S. Pat. No. 2,682,676. The device shown in this patent requires that the blinds be cleaned in their installed condition and could not be used to clean cloth blinds. Dyer U.S. Pat. No. 3,314,819 discloses yet another window blind apparatus utilizing a combination of sprayed liquid and brushes to clean window blinds. The device of the Dyer patent is a relatively complex device adapted to clean blinds in their installed position. It could not clean cloth blinds effectively. Schreiber U.S. Pat. No. 4,897,122 discloses a relatively expensive apparatus in which blinds are cleaned by spraying. The Schreiber equipment requires a high pressure source and heater.

SUMMARY OF THE PRESENT INVENTION

The present invention provides apparatus which is very simple in construction and permits blinds of either the open slat type or the cloth panel type to be cleaned quickly and in an effective manner so that no residue, either in the form of streaks or spots remains. Moreover, the present equipment permits the blinds to be cleaned without the use of brushes thereby minimizing any possibility of inadvertent damage.

Apparatus embodying the present invention comprises two tanks, a wash tank and rinse tank. Both tanks are filled with water to a level sufficient to cover a blind placed in the tank. The wash tank houses a plurality of elongated fluid conduits disposed adjacent to the bottom of the tank. Each conduit is provided with a plurality of relatively small upwardly directed openings. Recirculating water is supplied under a pressure of at least 30 psi and preferably at a pressure of about 40 to 60 psi while air is supplied at a pressure of at least 15 psi and preferably from 15 psi to 50 psi.

In operation a plurality of vortices are formed in the wash tank, one vortex being associated with each opening in the conduits. In other words a mass of whirling fluid rotates rapidly about an axis extending upwardly from each of the openings in the conduits. When a window blind is placed in the wash tank above the conduits the vortices form an agitated bath which effectively cleans the surface of the slats or cloth panel removing any adherent material. This cleaning action is enhanced by the addition of a detergent to the water.

The blinds are allowed to remain in the wash tank for a suitable length of time, for example two minutes and then are shifted to the rinse tank. The rinse tank, which is filled with water to a depth sufficient to cover the blinds is fitted with a plurality of conduits adjacent to the bottom of the tank. These conduits include a plurality of upwardly directed openings from which air under pressure is discharged to form an agitated rinse bath. The blinds are held in the rinse tank for a suitable period, for example one minute and are then removed and suspended in a drying area where they are permitted to air dry.

One advantage of the present invention is that the equipment utilized is relatively compact, inexpensive and easy to operate and maintain.

Another advantage of the present washing apparatus is that it can be utilized effectively to clean either window blinds of the type utilizing space slats of metal, plastic, wood or the like, or window blinds of the cloth type.

The present invention will be more readily understood from a consideration of the following detailed description of the drawings illustrating a preferred embodiment of the invention.

DETAILED DESCRIPTION OF A PREFERRED EMBODIMENT

Figure 1:
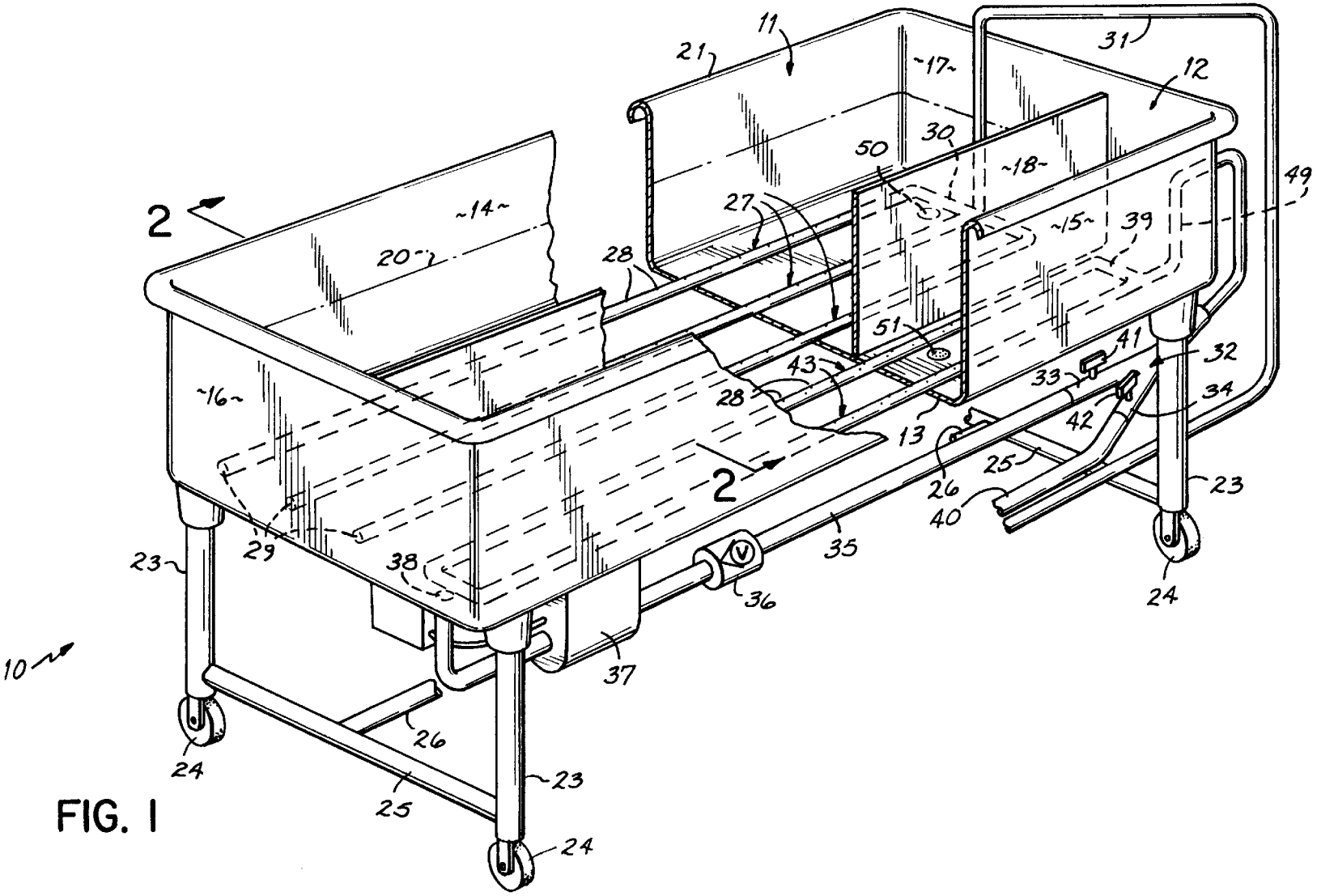
FIG. 1 is a perspective view of a preferred form of window blind washing apparatus embodying the principles of the present invention.

A preferred form of window blind washing apparatus 10 constructed in accordance with the principles of the present invention is shown in FIG. 1. As there shown the apparatus comprises a rinse tank 11 and a wash tank 12. In the embodiment shown these tanks are formed as part of a unitary structure. However, it is to be understood that the tanks may be constructed as separate components if desired. In the embodiment shown the unitary tank comprises a bottom wall 13 upstanding sidewalls 14 and 15 and end walls 16 and 17. An upstanding divider wall 18 extends upwardly from bottom wall 13 to an area adjacent to the upper edge 21 of end walls 16 and 17. The divider wall 18 extends generally parallel to side walls 14 and 15 and is effective to separate the wash tank 12 from the rinse tank 11.

In a preferred embodiment, the rinse tank 11 and wash tank 12 are approximately 72 inches long and have a combined width of approximately 45 inches with the wash tank being approximately 12" wide. The wash tank and rinse tank are approximately 12 inches deep. Each of these tanks is filled with water to a level 20 slightly below top edge 21 to provide a bath sufficient depth to accommodate a window blind 22 disposed within the tank.

As shown in FIG. 1, a preferred form of tank structure comprises four legs 23 extending downwardly from the corner areas of the tanks and carrying rollers 24 at the lower ends thereof. Suitable cross braces 25 interconnect the legs at each end of the structure and a longitudinal brace 26 is welded or otherwise attached to the two cross braces 25 adjacent to the midpoints thereof.

Preferably, rinse tank 11 houses three conduits or wands 27, although a greater or lesser number of wands could be used if desired. These wands extend parallel to one another closely adjacent to bottom wall 13. Each wand is provided with a plurality of openings 28 spaced along the upper surface of the wand and directed in a generally vertical direction. Each of the openings 28 is approximately $1/64^{th}$ of an inch in diameter and is spaced approximately 2" from the adjacent openings. In the preferred embodiment each of the conduits 27 is formed from a tube of PVC material with a ½" diameter.

The inlet ends of conduits 27 are inner connected to a cross or header pipe 30, while the ends 29 of conduits 27 remote from header 30 are capped or closed in any suitable manner. Header 30 communicates with an air supply conduit 31 connected to a source of pressurized air. The air is at a pressure above 15 psi and preferably within the range of from 15–50 psi although slightly higher pressures can be used.

Rinse tank 11 can be filled in a suitable manner, for example by means of a flexible hose (not shown). Drains 50, 51 are provided in bottom wall 13 for draining the rinse tank 11 and wash tank 12, respectively. It is to be understood that these drains are connected to a waste line (not shown).

Figure 3:
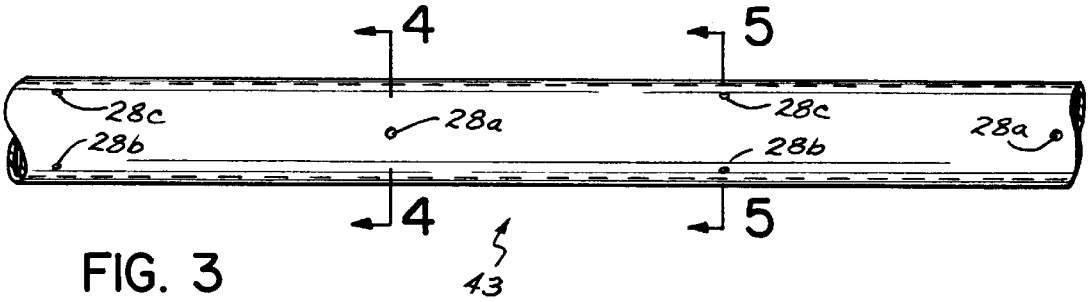
FIG. 3 is a top view of a portion of a conduit in the wash tank.
Figure 4:
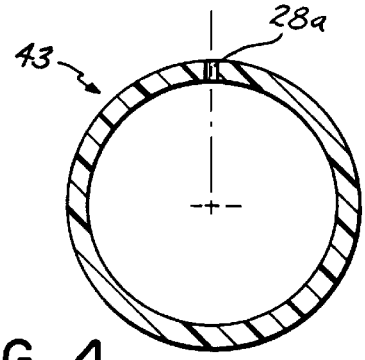
FIG. 4 is an enlarged cross-sectional view taken along line 4—4 of FIG. 3.
Figure 5:
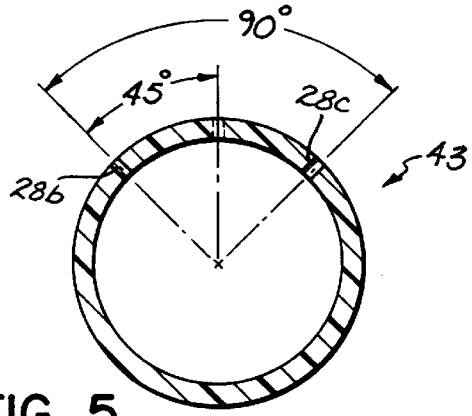
FIG. 5 is an enlarged cross-sectional view taken along line 5—5 of FIG. 3.

Preferably, wash tank 12 houses two elongated conduits 43. It is to be understood that a greater number of conduits can be provided if desired. These conduits are disposed adjacent to bottom wall 1 3 of the tank and extend generally parallel to side wall FIG. 14. As shown in FIG. 3–5, conduits 43 are provided with a plurality of apertures 28*a*, 28*b* and 28*c*, preferably about one sixty fourth of an inch in diameter. Apertures 28 are spaced longitudinally along conduit 27 approximately 2". The apertures alternate in configuration between a single aperture 28*a* pointed vertically and two apertures 28*b* and 28*c* pointed upwardly at an angle preferably about 45° from vertical. Conduits 43 are interconnected by pipe section 39. At their inlet end they are connected to a supply conduit 49. Conduit 49 is joined to a Wye fitting 32 having two inlet branches 33 and 34. Inlet branch 33 is connected to conduit 35 which is joined through anti-back flow valve 36 to the output of a recirculating pump 37. In the preferred embodiment the anti-back flow valve 36 is rated at 60 psi. Pump 37 is an electric pump having an output of 600 gallons per hour at an output pressure of 45–60 psi. The inlet to the pump is provided by conduit 37 which communicates with a drain 38 in the bottom wall 13 of wash tank 12.

Wye fitting 32 is a second inlet branch 34 connected to an air supply line. Air supply line 40 is are connected to a suitable source of air pressure adjustable from 15–60 psi. We have determined the effectiveness of the washing apparatus deteriorates substantially when air pressure is below 15 psi and when above 50 psi provides no appreciable improvement on the wash results. Wye fitting 32 is preferably provided with valves 41 and 42 for adjusting the air and water supply.

Figure 2:
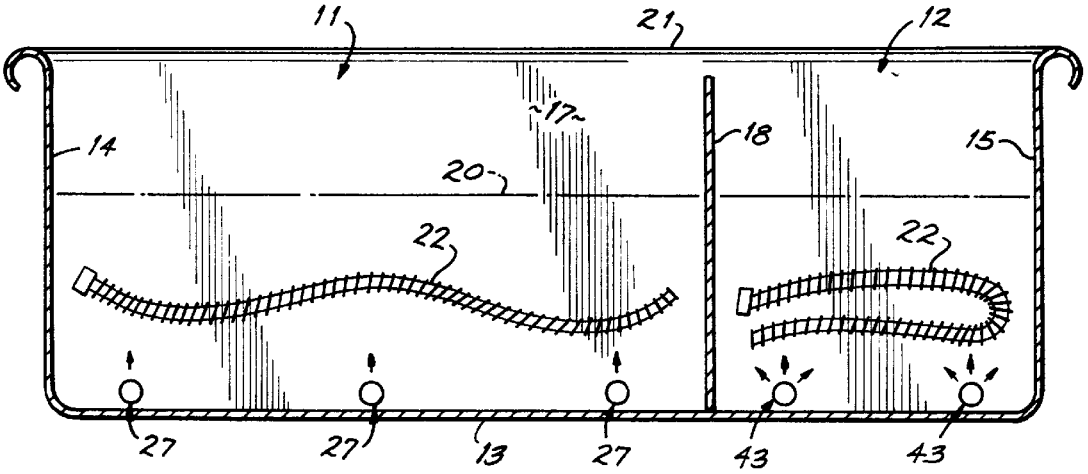
FIG. 2 is a transverse cross-sectional view through the wash tank and rinse tank portion of the apparatus taken along line 2—2 of FIG. 1.

In operation wash tank 12 and rinse tank 11 are filled with water at substantially ambient temperature. The water level in each of these tanks is sufficiently high so as to completely cover window blinds placed in the tank. In order to optimize the cleaning effect in the wash tank a suitable detergent is added at a concentration of approximately 4 oz. per 35 gallon and an anti-static compound is added at a ratio of approximately 2 oz. per 35 gallon. Pump 37 is started to recirculate water within the wash tank and air supply lines 40 and 31 are opened to compressed air under a pressure of at least 15 psi and preferably in the range 15–50 psi. The air and water are mixed in the Wye connection 32 and fed through conduit 49 to the elongated wands or conduits 43. The air and water mixture under pressure in these conduits is discharged through the openings 28*a*, 28*b* and 28*c* to create a plurality of vortices distributed over and extending upwardly from the lower portion of the wash tank. As shown in FIG. 2*a*, window blind with its slats pivoted to their open position is placed within the wash tank 12 and is covered with water. A vortex is formed adjacent to each of the openings 28*a*, 28*b* and 28*c* violently agitating the water detergent solution within the wash tank. The action of these vortices is effective to clean the blinds, effectively removing substantially all grease and accumulated deposits in a relatively short period of time, for example two minutes.

The blind is held within the wash tank 12 for this period of time in any suitable manner. After the selected wash time has elapsed the blind is removed and is transferred to the rinse tank 11, where it is held below the surface of the water and in spaced relationship to the wands 27. (See FIG. 2) The rinse water to which an anti-spotting agent has preferably been added is agitated by the compressed air escaping from openings 28 and effectively rinses substantially all residue adhering to the blind. The blinds are held in the wash tank for any suitable length of time preferably slightly over one minute. Thereafter the blinds are removed from the rinse tank, are extended to their open position and suspended in an area in which they can air dry.

Having described our invention we claim:

1. The method of cleaning window blinds comprising the steps of:

disposing an elongated blind having a surface to be cleaned in a washing tank containing a water bath of a depth sufficient to cover said blind;

discharging a mixture of pressurized air and water through openings in a conduit disposed below said blind;

said air being at a pressure of at least 15 psi and the water being at a pressure of at least 30 psi;

said water and air forming vortices contacting said blind to clean the said surface thereof;

and thereafter rinsing said blinds.

2. The method of claim 1 further comprising the steps of removing said blinds from said wash tank and inserting said blinds in a rinse tank containing a bath of water, directing air under pressure through a plurality of openings upwardly into said bath of water, said openings being disposed below said blind.

3. The method of claim 2 in which air is directed upwardly in said rinse tank from a first plurality of openings at a first angle to vertical, and from a second series of openings at a second angle on the side of vertical opposite from said first plurality of openings.

4. The method of claim 2 further comprising the steps of removing said blinds from said rinse tank and air drying said blinds.

5. The method of claim 1 comprising a further step of adding a detergent to the bath in said wash tank.

6. The method of claim 5 comprising a further step of adding an anti-static agent to said bath in said wash tank.

7. The method of claim 1 in which said air pressure is in the range of from about 15 psi to about 50 psi.

8. The method of claim 1 in which said water pressure is from about 40 psi to about 60 psi.

* * * * *